United States Patent [19]

Arrington et al.

[11] Patent Number: 4,666,528

[45] Date of Patent: May 19, 1987

[54] METHOD OF REMOVING IRON AND COPPER-CONTAINING SCALE FROM A METAL SURFACE

[75] Inventors: Stephen T. Arrington; Gary W. Bradley, both of Duncan, Okla.

[73] Assignee: Halliburton Company, Duncan, Okla.

[21] Appl. No.: 802,790

[22] Filed: Nov. 27, 1985

[51] Int. Cl.[1] ..... C23G 1/18

[52] U.S. Cl. ..... 134/2; 134/3; 134/28; 134/41; 252/82; 252/87

[58] Field of Search ..... 134/2, 3, 28, 29, 41; 210/698–701; 252/82, 87, 126, 127, 143, 180, 181

[56] References Cited

U.S. PATENT DOCUMENTS

| | | | |
|---|---|---|---|
| 3,308,065 | 3/1967 | Lesinski | 252/82 |
| 3,438,811 | 4/1969 | Harriman et al. | 134/2 |
| 3,447,965 | 6/1969 | Teumac | 134/3 |
| 3,804,770 | 4/1974 | Lorenc et al. | 210/700 |
| 3,854,996 | 12/1974 | Frost et al. | 134/2 |
| 3,996,062 | 11/1976 | Frost et al. | 134/2 |
| 4,387,027 | 6/1983 | May et al. | 210/701 |
| 4,452,643 | 6/1984 | Martin et al. | 134/3 |
| 4,578,162 | 3/1986 | McIntyre et al. | 134/3 |

*Primary Examiner*—Peter Hruskoci

*Attorney, Agent, or Firm*—Edward Sherer; Robert A. Kent

[57] ABSTRACT

A method of removing iron and copper containing scale from a metal surface by contacting the scale with a composition comprising an admixture of an aminopolycarboxylic acid, such as ethylenediaminetetraacetic acid (EDTA), or the alkali metal salts or ammonium salts or amine salts of the aminopolycarboxylic acid and a phosphonic acid such as aminotrimethylenephosphonic acid (ATMP), or an alkali metal salt or amine salt or ammonium salt of the phosphonic acid. The aminopolycarboxylic acid or salt thereof and phosphonic acid of salt thereof are present in the composition in an amount sufficient to provide a molar ratio of aminopolycarboxylic acid to phosphonic acid in the range of from about 1:9 to about 39:1.

17 Claims, No Drawings

METHOD OF REMOVING IRON AND COPPER-CONTAINING SCALE FROM A METAL SURFACE

BACKGROUND OF THE INVENTION

A. Field of the Invention

This invention relates to a method of removing iron and copper containing scale from a metal surface such as a ferrous metal surface whereby copper is not replated on the metal surface and the formation of undesirable precipitates is avoided.

B. Description of the Prior Art

In steam boilers, petrochemical process equipment, feed water heaters and associated piping, and in various types of pressure vessels, such as high pressure steam generating equipment utilized in electric power generation and other applications, in which water is circulated and heat transfer occurs, water-insoluble salts deposit as scale on the metallic interior surfaces. The formation or depositation of scale markedly reduces the heat transfer through the walls of such pipes or vessels and furthermore, the capacity of the pipes or vessels and passage of fluids therethrough is restricted by the formation of such scale. Because the scale formation on the inner surfaces of the pipes, particularly in heat transfer applications, the pipes are subject to excessive heat due to the loss of the heat transfer capacity. Furthermore, great pressures are required to overcome the restricting effect of the deposited scale. These disadvantages often lead to leaks and ruptures which necessitate undesirable down time and maintenance costs. Still further, the reduced cross-section of the pipes caused by the formation of the scale can cause an increased pressure drop.

The scale deposit on the vessels many times contains oxides of various metals such as iron oxides, e.g. magnetite and hematite. In addition, the scale deposit on the vessels can contain deposits of other iron salts. Furthermore, many times vessels are associated with equipment such as condensers, that are constructed, in part, from alloys of copper, and the scale produced on the inner surface of the vessel is frequently found to contain copper scale as well, in the form of elemental copper and sometimes copper oxides such as cuprous and cupric oxides. In addition, the copper scale can contain other copper salts such as cuprous phosphate.

Many types of methods have been proposed for removing copper and iron-containing scale from a metal surface, such as a ferrous metal surface. One method of removing copper and iron-containing scale from a ferrous metal surface involves the use of a strong mineral acid, particularly hydrochloric acid, for purposes of dissolving the scale found on the surface of the process equipment, boilers, feedwater heaters, and other types of vessels. Although utilization of corrosion inhibitors with mineral acids for cleaning operations has generally prevented acid attack on the equipment surface, such acid treatments have not been universally successful because, when the scale contains copper or copper oxides, many times copper is not dissolved during the cleaning operation and such copper that is dissolved is redeposited as elemental copper throughout the interior of the surfaces of the vessel. Such copper redepositation serves to accelerate corrosion and to interfere with heat exchange reactions.

U.S. Pat. Nos. 3,854,996 and 3,996,062, which are assigned to the assignee of the present invention and are hereby incorporated by reference, disclose the use of polyphosphonic acid or the alkali metal or amine salt of this acid to remove copper and iron-containing scale from a ferrous metal surface. Although the process described in these patents has met with commercial success, the use of a composition containing, principally, polyphosphonic acid or the amine or alkali metal salts of this acid, presents certain difficulties. For instance, during a cleaning process utilizing the polyphosphonic acid or its salts, an insoluble curdy, adhesive precipitate can be formed which may damage the equipment sought to be cleaned. The formation of the precipitate is of particular significance when iron content of the cleaning solution exceeds 0.9 weight percent of the cleaning solution.

Another proposed procedure for removing copper containing iron oxide scale from metal surfaces comprises contacting the metal surfaces with an aqueous, alkaline, solution containing an ammonium, amine, or hydroxy alkylamine salt of nitrilotriacetic acid, N-2-hydroxyethylamino diacetic acid, or an alkylenepolyamine aminopolycarboxylic acid. The use of this composition for removing iron and copper containing scale from a metal surface can result in the formation of an insoluble precipitate which adheres to the metal surfaces being cleaned. These precipitates must be removed from the metal surface either by mechanical means or by a different chemical removal treatment. It is believed that the precipitates can be prevented by maintaining in the cleaning solution an amount of chelating agent in excess of the amount theoretically required to complex the dissolved metals. This procedure, however, requires close analytical control of the cleaning solution and also increases the expense of the cleaning operation as a greater than stoichiometric amounts of the chelant must be maintained in the cleaning composition.

It is therefore desirable to provide a method of removing copper and iron containing scales from a metal surface, such as a ferrous metal surface, which is dependable, does not form undesirable precipitates, and which does not result in the redepositation of copper during the cleaning operation.

SUMMARY OF THE INVENTION

In accordance with the invention, there is provided a method of removing iron and copper containing scale from a metal surface, such as a ferrous metal surface, comprising contacting the scale containing surface at a temperature of from about 150° F. to about 350° F. with an aqueous scale removing composition having a pH of from about 4.0 to 10.5 and maintaining the composition in contact with the scales for a time sufficient to remove the iron containing scale from the metal surface, adjusting, when necessary, the pH of composition to from about 8.0 to about 10.5 and the temperature to from about 120° F. to about 180° F., and contacting the copper containing scales for a time sufficient to remove the scales from the metal surface.

The term "pH" as used throughout the specification and claims refers to the pH value of the cleaning composition measured at ambient temperature.

The aqueous scale removing composition used in the method of the invention comprises an admixture of an aminopolycarboxylic acid or an alkali metal, ammonium, or amine salt of the aminopolycarboxylic acid and a phosphonic acid or alkali metal, ammonium or amine salt of the phosphonic acid.

The present invention provides a process which is dependable for removing copper and iron containing scale from a metal surface, does not form undesirable precipitates which can be deposited on the metal surface, and does not result in the redepositation of copper on the metal surface being cleaned.

DESCRIPTION OF THE PREFERRED EMBODIMENTS

The method of the invention can be broadly described as contacting a metal surface, such as a ferrous metal surface, containing iron and copper containing scale at a temperature of from about 150° F. to about 350° F. with an aqueous composition having a pH of from about 4.0 to about 10.5 and comprising an admixture of an aminopolycarboxylic acid or alkali metal, ammonium, or amine salt of the aminopolycarboxylic acid and a phosphonic acid or alkali metal, ammonium or amine salt of the phosphonic acid; maintaining said composition in contact with said scales for a time sufficient to remove the iron containing scale from the metal surface; adjusting, when necessary, said pH of the composition to from about 8.0 to about 10.5 and said temperature to from about 120° F. to about 180° F., and contacting said copper containing scales for a time sufficient to remove said copper containing scales from said surface.

The aminopolycarboxylic acid and the phosphonic acid are present in the composition in an amount sufficient to produce a molar ratio of the aminopolycarboxylic acid or the salt of the aminopolycarboxylic acid to the phosphonic acid or salt of the phosphonic acid in the range of from about 1:9 to about 39:1. Preferably the molar ratio is in the range of from about 1:1 to about 19:1. Most preferably the molar ratio is about 9:1.

The aminopolycarboxylic acids suitable for use in the method of the invention include ethylenediaminetetraacetic acid (EDTA), N-hydroxyethyl ethylenediamine triacetic acid (HEEDTA), nitrilotriacetic acid (NTA), N-2-hydroxyethyliminodiacetic acid, diethylenetriamine pentaacetic acid, N-2-hydroxyethyl ethylenediamine triacetic acid, propylene-1,2-diamine tetracetic acid, propylene-1, 3-diamine tetraacetic acid, the alkali metal, ammonium and amine salts of the aminopolycarboxylic acids, and mixtures thereof. The preferred aminopolycarboxylic acid for use in the method of the invention is NTA.

The phosphonic acids utilized to carry out the method of the present invention include aminotrimethylenephosphonic acid (ATMP) ethylenediaminetetramethylenephosphonic acid, hexamethylenediaminetetramethylenephosphonic acid, 1-hydroxyethylidene-1,1-diphosphonic acid. The preferred phosphonic acid is aminotrimethylenephosphonic acid.

A characteristic of this invention is that, in one embodiment of the invention, the method is carried out as a two-step procedure in which the iron containing scale is removed during the first step and, during the second step, copper containing deposits on the metal surface are removed by adjusting, when necessary, the pH of the solution into the range of from about 8.0 to about 10.5 and the temperature to from about 120° F. to about 180° F. Furthermore, the iron content (as elemental iron) of the cleaning composition during use can exceed 1.0 percent by weight of composition.

The temperature at which the iron containing scale is removed is generally from about 150° F. to about 350° F. and the pH employed is broadly from about 4.0 to about 10.5. Preferably, the temperature range of this step is from about 225° F. to about 275° F. and the pH range is from about 8.0 to 10.0, and most preferrably the temperature is about 250° F. and the pH is about 9.0.

The temperature at which copper containing deposits are removed from the metal surface is preferably about 150° F. and the pH is preferably about 9.0.

The contact time over which the process is continued is generally from about 30 minutes to a maximum of about 24 hours. The molar iron and molar copper content (as elemental iron and copper) during the use of the cleaning solution is preferably not in excess of the molar concentration of the aminopolycarboxylic acid and the phosphonic acid or alkali metal, ammonium, and amine salts of these acids. It is important to note that temperature, pH, and iron and copper content are interrelated so that the particular values of each of the parameters which is employed will be dependent upon the value of other parameters.

Having broadly eluded to the method of the invention and cited certain salient characterisics of the composition used in the method, the subsequent description herein will be directed to a consideration of certain preferred embodiments of the invention and to a detailed description of these embodiments in conjunction with examples set forth as illustrative of typical practice of the invention and utilizing certain preferred embodiments of the invention.

As has been previously stated, the composition used in the method of the invention contains a phosphonic acid, or the amine, ammonium, or alkali metal salts thereof and an aminopolycarboxylic acid such as EDTA or NTA, or the ammonium, amine, or alkali metal salts of the aminopolycarboxylic acid.

When salts of the described phosphonic acids are used, or are formed in situ, the preferred cations involved in the salt formation are those derived from ammonia or ammonium hydroxide, ethylenediamine, and alkali metal hydroxides. The most preferred single cationic species used in the salt formation is the ammonium ion. There are occasions, however, upon higher temperature usage of the cleaning process of the invention, where the volatility of ammonia may render its usage less desirable than the usage of alkali metal hydroxides for salt formation due to the susceptibility of the system under such conditions to the shifting of pH from an optimum range upon volatilization of ammonia.

It is beneficial to include a pH adjusting compound with the aqueous composition of the present invention. The most general usage of the composition of the invention is carried out under alkaline conditions and, as will hereinafter be explained, for extremely valuable applications of the method of the invention, maintenance of the pH of the cleaning solution during treatment at a relatively high pH is desirable. For the purpose of adjusting and maintaining the pH within this frequently desired range of alkalinity during the metal surface treatment, the pH adjusting to which reference has been made, is added to the aqueous solution. Thus, the preferred pH adjusting compounds are amines, including ammonia and ammonium compounds and alkali metal hydroxides. Of these, the most preferred for general usage is ammonium hydroxide. Others which are suitable include, ethylenediamine, sodium hydroxide, potassium hydroxide, lithium hydroxide, monoethanolamine, diethanolamine, and triethanolamine.

Although the type of water used in the aqueous solutions containing the aminopolycarboxylic acid and phosphonic acid described above is not critical to the practice of the invention, there are many applications of the process of the invention which make it desirable on such occasions to use potable water or water which is as nearly salt free as possible such as demineralized water.

The combined weight of aminopolycarboxylic acid and phosphonic acid used in the practice of the invention may vary over a wide range with no real limitations. Aqueous cleaning solutions which contain as little as 0.5 weight percent of aminopolycarboxylic acid and phosphonic acid (combined weight) are effective in removing the iron and copper containing scale. A practical upper limit of the concentration of aminopolycarboxylic acid and phosphonic acid is about 10.0 percent by weight of the aqueous composition. In general, the most effective and preferred concentration range of the aminopolycarboxylic acid and phosphonic acid is from about 1.5 weight percent to about 6.0 weight percent. In this range, the cleaning solution demonstrates excellent iron and copper complexing capacity and has a relatively high carrying capacity for dissolved iron and copper.

The amount of pH adjusting material which is used in the composition will be varied in accordance with the pH at which it is desired to conduct the cleaning operation. Thus, the amount of pH adjusting or buffering material used in the composition is that amount which is effective over the pH range of the method. A preference for alkaline pH condition is generally preferred and this is, to some extent, dictated by customs of the trade which favor alkaline treatment of boilers and related equipment, but effective iron containing scale removal can be accomplished in the pH range of from about 4.0 to about 10.5. Effective copper scale removal can be effected in the range of from about 8.0 to about 10.5. Preferably, the iron scale removal is carried out at a pH of from about 8.0 to 10.5 and most preferably at a pH of about 9.0. Preferably the copper scale removal is carried out at a pH of about 9.0. When an ammonium compound as utilized for pH adjustment, and particularly ammonium hydroxide, it will usually be desirable to add a sufficient amount of ammonium compound to commence the cleaning process near the upper end of the pH range over which it is desired to conduct the cleaning. This will then allow for some loss of ammonium compound by volatilization so that the pH, though it drops some over the period of cleaning, will still be within the desired range at the termination of the cleaning operation.

Preferably, the aqueous composition further includes a small amount of a corrosion inhibiting compound. This compound functions, in the course of the cleaning procedure, to protect the metal surface from direct attack by the cleaning composition. In some metal cleaning operations, the removal of small amounts of metal from the surface being cleaned is not intolerable, but this will rarely be the case. In general, from about 0.1 to about 0.2 volume percent or more of corrosion inhibiting compound is included in the composition. An amount of about 0.2 volume percent of corrosion inhibitor has been found to be sufficient to attain corrosion inhibition at temperatures up to 350° F. It is particularly important that the inhibitor be included when the scale removal is carried out at relatively high temperatures, i.e., from about 225° F. to about 350° F. Typical corrosion inhibiting compounds which can be effectively employed in the compositions of the invention include, but are not limited to, alkyl pyridines, quaternary amine salts and dibutylthiourea, and mixtures of these materials with each other and/or with carrier or surface active materials such as ethoxylated fatty amines.

As previously described, the method of the invention is preferably carried out when the aqueous composition has a relatively high pH range. When the iron containing scale is removed from the ferrous metal surface at a pH of from about 8 to about 10.5, usually no pH adjustment is required during the copper removal step. In addition, when the iron removing step is carried out at a temperature of from about 150° F. to about 180° F., no temperature adjustment is required during the copper removing step. Thus, when the method is carried out at a temperature of from about 150° F. to about 180° F. and the pH is adjusted from about 8 to about 10.5, the method of the present invention of removing iron and copper containing scale is, in most instances, a one-step process requiring no temperature and no pH adjustments.

The aqueous composition of the present invention, preferably, contains an oxidizing agent during the copper containing scale removal step, which is capable of oxidizing the iron present in the aqueous composition from a ferrous to ferric valence state, in order to prevent the ferrous ions from otherwise being competitive with the copper and reacting with the oxidizing agent. A sufficient amount of the oxidizing agent should be present in the composition to oxidize copper, which has been deposited on the metal substrate, to cupric ions. This permits the copper to exist in a valence state which facilitates its complexing in the aqueous solution. The amount of oxidizing agent which is included in the aqueous composition for a particular iron and copper removal operation will vary widely depending upon the amount of iron and copper scale which is encountered. The amount of oxidizing agent present is preferably an amount sufficient to stoichiometrically oxidize all of the lower valence iron in the scale removing solution at the time after all of the iron scale has been removed and an additional amount which is equal to, or exceeds, the stoichiometric quantity required for reacting all of the copper which is to be removed from the metal surface.

A number of types of oxidizing agents can be included in the aqueous composition. Typical oxidizing agents which can be effectively employed include, but are not limited to, the alkali metal bromates, the alkali metal peroxides, the alkali metal perborates, potassium permanganate, hydrogen peroxide, air, oxygen, ozone, alkali metal and ammonium nitrites and mixtures thereof. In addition, the oxidizing agent may be ferric ions which occur naturally in the iron containing scale or oxygen in the aqueous composition. The preferred oxidizing agents are air, sodium nitrite, and combinations thereof.

The amount of scale removing aqueous composition which should be employed in carrying out the process of the invention is not susceptible to precise definition since the amount of iron and copper containing scale will vary from one cleaning operation to another. Furthermore, in any given instance, it is not possible to calculate or estimate, except by rough approximation, the amount of iron and copper which may be present on the metallic surface to be cleaned. In general, there should be utilized an amount of aqueous scale removing composition such that, considering the concentration of the active sequestering material therein, there is sufficient amount of the aqueous composition to combine stoichiometrically with the amount of iron and copper containing scale which is present and which is to be removed. Use of amounts of the aqueous composition in excess of the stoichiometric amounts described is not harmful to the operation, except when a point is reached at which the dissolved acids and other materials unsuitably limit the carrying capacity of solution. This limitation is generally encountered, however, only at a point where the economic desiderata have already dictated a limitation to the amount of cleaning solution employed. The reaction between the aminopolycarboxylic acid and phosphonic acid and the copper containing scale, which is to be removed, can be electrochemically monitored, wherein the presence of an oxidizing agent included in the composition is measured. Thus, in this instance, the absence of an oxidizing agent indicates the probability that the copper containing scale is still present.

During the iron containing scale removal step, the temperature of the scale removing composition is preferably about 225° F. to about 275° F. and the pH of the composition is about 9.0. Preferably, the copper containing scale removal step is carried out at 150° F. and at a pH of about 9.0. In addition, an oxidizing agent, such as sodium nitrite, is preferably included in the aqueous composition during the removal of the copper containing scale.

The metal surface to be cleaned is contacted by the cleaning solution of this invention by any suitable method, e.g., soaking, pouring, spraying, circulating, and the like. The cleaning solution of this invention is particularly suitable for cleaning the inside of vessels of complex shapes where the formation of a curdy, adhesive percipitate would present difficult removal problems. Normally, the area to be cleaned is contacted by filling the vessel with the cleaning solution of this invention. It is found that the iron and copper removal can be particularly enhanced by stirring or by other suitable means of agitation during the contacting step.

During the iron removal step, the temperature of the solution is maintained in the range of from about 150° F. to about 350° F. and preferably 225° F. to 275° F. for a time sufficient to dissolve the iron containing scale. The time of dissolution of the iron containing scale is generally in the range of from about 2 to 12 hours. Usually the time of dissolution is from about 4 to about 8 hours. If the deposit comprises merely iron containing scale, only the iron removal step is required during the cleaning operation.

During the removal of the copper containing scale, the temperature of the aqueous composition is adjusted, when necessary, from about 120° F. to about 180° F. and preferably 150° F. for a time sufficient and the pH is adjusted, when necessary, to the range of from about 8.0 to about 10.5. The aqueous composition is allowed to circulate for a time sufficient to dissolve the copper containing depositations. Preferably, the aqueous composition contains an oxidizing agent to dissolve the copper containing depositations.

The invention is further exemplified by the examples below which are presented to illustrate certain specific embodiments of the invention, but are not intended to be construed so as to be restrictive of the scope and spirit thereof.

EXAMPLE I

A series of tests were carried out to demonstrate the magnetite and copper dissolving capability of the method of the invention. The cleaning compositions utilized had a pH of about 9 and comprised an admixture containing amounts of aminotrimethylenephosphonic acid (ATMP), as the phosphonic acid, and nitrilotriacetic acid (NTA) or ethylenediaminetetraacetic acid (EDTA) as the aminopolycarboxylic acid, and 0.2 percent by volume of a corrosion inhibitor. A molar concentration of 0.137 of ATMP and NTA or EDTA was utilized in Tests 1 through 13 of Table I and Tests 1 through 4 of Table II. A molar concentration of 0.069 of ATMP and NTA or EDTA was utilized in Tests 1 through 4 of Table III.

The tests were carried out by placing, in a container, 200 ml. of the composition described above. Next, a magnetite source and a copper source was added to the container containing the composition. The magnetite source was a magnetite scaled reheater tube section having a length of about 1 inch and an inner diameter of about 1.5 inches. The copper source was a copper plated pipe section having a 1 inch nominal diameter and a length of about 1 inch. The containers were sealed and placed into a sealed autoclave. The autoclave was heated to 275° F. for 16 hours. The autoclave was then cooled to 200° F. and the containers were removed therefrom. The containers were placed in a water bath which was maintained at 150° F. The containers were then opened after 45 minutes and about 0.5% by weight of sodium nitrite ($NaNO_2$) was added to each composition. Air was blown into each composition at a rate of 175 scfm/10,000 gal for a period of 4 hours by forcing air through a small bore glass tube immersed in the composition.

The final volume of the composition and iron and copper content of each solvent was determined upon conclusion of the test. Samples exhibiting any traces of visible precipitation were analyzed twice, once without filtration and a second time after filtration through a 0.45 micron media.

All analytical results presented in this report are averages of at least duplicate tests. Analytical results have been corrected for any solvent evaporation by the use of the following formula:

$$\text{Concentration (mpl)} = \text{Analytical result (mpl)} \times \frac{\text{Final Volume (ml)}}{\text{Initial Volume (ml)}}$$

The results of these tests is shown in Tables I, II and III.

TABLE I

| Test No. | NTA (mol %) | ATMP (mol %) | Mpl Fe (dissolved) | Mpl Cu (dissolved) | Molar Ratio [Metal]:[Chelant] | Precipitate (Visually Observed) |
|---|---|---|---|---|---|---|
| 1. | 100 | 0 | 1698 | 572 | 0.29 | * |
| 2. | 97.5 | 2.5 | 7180 | 923 | 1.04 | ** |
| 3. | 95 | 5 | 7838 | 1006 | 1.14 | none |
| 4. | 90 | 10 | 7754 | 1121 | 1.14 | none |
| 5. | 80 | 20 | 8176 | 1080 | 1.19 | none |
| 6. | 70 | 30 | 7814 | 815 | 1.11 | none |

TABLE I-continued

| Test No. | NTA (mol %) | ATMP (mol %) | Mpl Fe (dissolved) | Mpl Cu (dissolved) | Molar Ratio [Metal]:[Chelant] | Precipitate (Visually Observed) |
|---|---|---|---|---|---|---|
| 7. | 60 | 40 | 8038 | 795 | 1.14 | none |
| 8. | 50 | 50 | 8509 | 948 | 1.22 | none |
| 9. | 40 | 60 | 8432 | 915 | 1.21 | none |
| 10. | 30 | 70 | 8510 | 829 | 1.21 | none |
| 11. | 20 | 80 | 8289 | 913 | 1.19 | none |
| 12. | 10 | 90 | 8742 | 822 | 1.23 | none |
| 13 | 0 | 100 | 6913 | 1003 | 1.02 | none |

* Heavy precipitation noted during Cu dissolution stage.
** Solution cloudy after Cu dissolution stage.

TABLE II

| Test No. | EDTA (mol %) | ATMP (mol %) | Mpl Fe (dissolved) | Mpl Cu (dissolved) | Molar Ratio [Metal]:[Chelant] | Precipitate (Visually Observed) |
|---|---|---|---|---|---|---|
| 1. | 100 | — | 6585 | 926 | 0.97 | * |
| 2. | 95 | 5 | 7275 | 879 | 1.05 | none |
| 3. | 90 | 10 | 8018 | 998 | 1.16 | none |
| 4. | 80 | 20 | 7529 | 1009 | 1.10 | none |

*Precipitation evident during the Cu stage.

TABLE III

| Test No. | EDTA (mol %) | NTA (mol %) | ATMP (mol %) | Mpl Fe (dissolved) | Mpl Cu (dissolved) | Molar Ratio [Metal]:[Chelant] | Precipitate (Visually Observed) |
|---|---|---|---|---|---|---|---|
| 1. | 70 | 0 | 30 | 3774 | 1057 | 1.22 | none |
| 2. | 50 | 0 | 50 | 3129 | 1000 | 1.04 | none |
| 3. | 10 | 0 | 90 | 4411 | 949 | 1.36 | none |
| 4. | 0 | 80 | 20 | 3073 | 1003 | 1.00 | none |

The test results show that the method of the invention was very effective in dissolving iron and copper scale without the formation of undesirable precipitates.

EXAMPLE II

A series of tests were carried out to demonstrate the magnetite and copper dissolving capability of the method of the invention. The cleaning composition had a pH of about 9, had a volume of 300 ml, and comprised an admixture containing varying amounts of nitrilotriacetic acid (NTA) and aminotrimethylenephosphonic acid (ATMP).

The tests were carried out by placing a known volume of the cleaning composition in an autoclave containing a scaled tube sample. The autoclave was heated to 275° F. and maintained at this temperature for a predetermined time period. The autoclave was cooled to less than 200° F. and then placed in a waterbath maintained at 150° F. Approximately one hour was allowed for the autoclave to reach thermal equilibrium with the waterbath.

The autoclave was opened and the tube sample was visually examined. Samples of the cleaning composition were analyzed for dissolved iron content by a colorimetric procedure. 0.5% $NaNO_2$ was added to the cleaning composition and air was injected into the solvent at a rate of 50 scfm/10,000 gallons (37.4 cc/min-lit). Samples of the cleaning composition were periodically analyzed for iron and copper content and cleaning composition was adjusted as needed.

The tube samples used in the tests had the following qualitative analysis:

TABLE IV

| Tube Sample Designation | TS-1 | TS-2 | TS-3 | TS-4 | TS-5 |
|---|---|---|---|---|---|
| DEPOSIT | | | | | |
| $Fe_3O_4$ | Major | Moderate | Major | Large | Major |
| $Fe_2O_3$ | — | Small | Trace | Sm-Moderate | Small |
| Cu | Trace | — | — | Sm-Moderate | Sm-Moderate |
| $Cu_2O$ | — | — | — | Sm-Moderate | — |
| CuO | — | — | — | Sm-Moderate | — |
| $\alpha FeO(OH)$ | — | Large | — | — | — |
| $\beta FeO(OH)$ | — | Large | — | — | — |
| $\gamma FeO(OH)$ | — | Very Small | — | — | — |
| $FeCO_3$ | — | Trace | — | — | — |
| $Ca_5(PO_4)_3OH$ | — | — | — | — | Trace |
| DENSITY | | | | | |
| $g/ft^2$ | 14 | 259 | 45 | 87 | 206 |

The results of these tests are shown in Tables V and VI.

TABLE V

Test Length - 15 hrs Temperature - 275° F.
All compositions were inhibited with 0.1% by weight corrosion inhibitor

| Test No | Tube Sample Designation | Solvent Volume (ml) | % by weight NTA | % by weight ATMP | Theoretical % by weight Fe | Observed % by weight Fe |
|---|---|---|---|---|---|---|
| A. | TS-1 | 100 | 2.35 | 0.41 | 0.76 | 0.88 |
| B. | TS-2 | 300 | 4.70 | 0.82 | 1.53 | 1.43 |
| C. | TS-3 | 200 | 2.35 | 0.41 | 0.76 | 0.88 |
| D. | TS-4 | 150 | 4.70 | 0.82 | 1.53 | 1.86 |
| E. | TS-5 | 300 | 4.70 | 0.82 | 1.53 | 1.13 |

Observations:
TS-1 - Tube Clean
TS-2 - Large amount of scale still present on tube
TS-3 - White tan deposit present on 50% of tube
TS-4 - Large amount of Cu present on tube
TS-5 - Scale still present on tube, bare metal is copper plated
All Solvents - Light green in color, no ppt. in any solvent

TABLE VI

Test Length - 4 hrs Oxidant - 0.5% $NaNO_2$ + 50 scfm/10,000 gal airblow
Temperature - 150° F.
All compositions previously subjected to iron oxide stage of 15 hrs at 275° F. (See Table V)

| Test No. | Tube No. | % by weight NTA | % by weight ATMP | % by weight Fe | % by weight Cu | [metal]/[chelant] |
|---|---|---|---|---|---|---|
| A. | TS-1 | 2.35 | 0.41 | 0.88 | 0.0 | 1.15 |
| B. | TS-2 | 4.70 | 0.82 | 1.35 | 0.0 | 0.88 |
| C. | TS-3 | 2.35 | 0.41 | 0.88 | 0.0 | 1.15 |
| D. | TS-4 | 4.70 | 0.82 | 0.92 | 0.19 | 0.71* |
| E. | TS-5 | 4.70 | 0.82 | 1.19 | 0.05 | 0.81 |

*Precipitate formed during the copper removal portion of this experiment.

The results of these tests show that the cleaning composition was effective in removing the scale from the table samples. Generally, the amount of chelant required in a cleaning operation is dependent upon the amount of iron oxide and copper removed. The precipitate formed in Test No. D did not adhere to the table sample.

EXAMPLE III

A second test was preformed on TS-4 utilizing 300 ml of a cleaning composition comprising 4.7 percent by weight NTA and 0.82 percent by ATMP (150 ml of cleaning composition was utilized in Test No. D). Analysis of the composition indicated that 1.76% Fe was present in composition after 15 hours at 275° F. This amount of iron represents approximately 115% of that theoretically soluble in this solvent.

An additional 1.5 g (0.5%) NTA and 0.33 g (0.11%) $NH_3$ were added to the solvent to reduce the metal to chelant ratio to approximately 1.05. The solvent was then subjected to a passivation and copper removal stage consisting of the addition of 1.5 g (0.5%) $NaNO_2$ combined with continuous air injection. The result of this test is shown in Table VII.

TABLE VII

| | |
|---|---|
| Initial Solvent | Ammoniated 4.7% NTA + 0.82% ATMP + 0.1% corrosion inhibitor, pH = 9.0 |
| Solvent Volume | 300 ml |
| Iron Oxide Stage | 15 hrs @ 275° F. |
| Oxidation during Cu Stage | 0.5% $NaNO_2$ + 50 scfm/10,000 gal airblow |

| Time (hrs) | % Fe | % Cu | [metal]/[chelant] | REMARK |
|---|---|---|---|---|
| 0.0 | 1.76 | 0.00 | 1.15 | Add 0.5% NTA + 0.46 vol % 30% Ammonia |

TABLE VII-continued

| | |
|---|---|
| Initial Solvent | Ammoniated 4.7% NTA + 0.82% ATMP + 0.1% corrosion inhibitor, pH = 9.0 |
| Solvent Volume | 300 ml |
| Iron Oxide Stage | 15 hrs @ 275° F. |
| Oxidation during Cu Stage | 0.5% $NaNO_2$ + 50 scfm/10,000 gal airblow |

| Time (hrs) | % Fe | % Cu | [metal]/[chelant] | REMARK |
|---|---|---|---|---|
| 1.0 | 1.73 | 0.18 | 1.13 | |
| 3.0 | 1.72 | 0.27 | 1.17 | Add 0.5% NTA + 0.46 vol % 30% Ammonia |
| 4.0 | 1.70 | 0.34 | 1.10 | Add 0.5% NTA + 0.46 vol % 30% Ammonia |
| 5.0 | 1.66 | 0.31 | 0.98 | |
| 6.0 | 1.66 | 0.31 | 0.98 | |

The entire copper dissolution portion of this test was conducted at a [metal]/[chelant] ratio of about 1.0 to 1.17. No precipitation was apparent at any time during the test. Additions of NTA and $NH_3$ were made at 3 and 4 hours into the copper stage. These additions only served to return the [metal]/[chelant] ratio to approximately 1.0.

Analysis of the composition at the conclusion of the test indicated 1.66% Fe and 0.31% Cu present in the composition. Examination of the tube specimen revealed a small amount of copper still present in the bottom of pits on one side of the tube. The remainder of the tube was medium grey in color and appeared passive. No rusting was apparent on the tube metal after 4 days of exposure to laboratory conditions.

Although certain preferred embodiments of the invention have been described for illustrative purposes, it will be appreciated that various modifications and innovations of the procedures and compositions recited herein may be effected without departure from the basic principles which underlie the invention. Changes of this type are therefore deemed to lie within the spirit and scope of the invention except as may be necessarily limited by the amended claims or reasonable equivalents thereof.

What is claimed is:

1. A method of removing iron and copper containing scale from a metal surface comprising the steps of:

(a) contacting said scale containing surface at a temperature of from about 150° F. to about 350° F. with an aqueous scale removing composition having a pH of from about 8.0 to about 10.5 and comprising an admixture of (i) an aminopolycarboxylic acid selected from the group consisting of ethylenediamine tetraacetic acid, N-hydroxyethylethylenediaminetriacetic acid, nitrilotriacetic acid, N-2-hydroxyethyliminodiacetic acid, diethylenetriamine pentaacetic acid, N-2-hydroxyethylethylene diaminetriacetic acid, propylene-1,3-diaminetetraacetic acid, propylene-1,2-diaminetetraacetic acid, the alkali metal, amine and ammonium salt of the aminopolycarboxylic acids, and mixtures thereof; and (ii) a phosphonic acid selected from the group consisting of aminotrimethylenephosphonic acid, ethylenediaminetetra-methylenephosphonic acid, hexamethylenediaminetetra-methylenephosphonic acid, 1-hydroxyethylidene-1,1-diphosphonic acid, the alkali metal, amine and ammonium salt of the phosphonic acid and mixtures thereof;

(b) maintaining said composition in contact with said scales for a time sufficient to remove said iron containing scale from the metal surface;

(c) adjusting said pH of said composition to from about 8.0 to about 10.5 when said pH of said composition is outside the range of from about 8.0 to about 10.5 and said temperature to from about 120° F. to about 180° F. when said temperature is outside the range of from about 120° F. to about 180° F. prior to removal of said copper containing scale; and, (d) contacting said copper containing scales with said composition for a time sufficient to remove said copper containing scales from said surface;

wherein said aminopolycarboxylic acid and said phosphonic acid are present in said composition in an amount sufficient to produce a molar ratio of aminopolycarboxylic to phosphonic acid in the range of from about 1:9 to about 39:1, wherein the combined weight of the aminocarboxylic acid and phosphonic acid present in said composition is in the range of from about 1.5 percent by weight to about 6.0 percent by weight of the composition, and wherein the composition of step (c) further comprises an oxidizing agent present in an amount sufficient to oxide substantially all the ferrous ions present in said composition to ferric ions and substantially all the copper which is to be removed from said metal surface to cupric ions.

2. The method recited in claim 1 wherein said aminopolycarboxylic acid is selected from the group consisting of NTA, EDTA, and mixtures thereof.

3. The method recited in claim 2 wherein the molar ratio of the aminopolycarboxylic acid to phosphonic acid is in the range of from about 1:1 to about 19:1.

4. The method recited in claim 3 wherein the molar ratio of the aminopolycarboxylic acid to the phosphonic acid is about 9:1.

5. The method recited in claim 4 wherein the pH of the composition of step (a) is in the range of from about 8.0 to about 10.0.

6. The method recited in claim 5 wherein the pH of the composition of step (c) is about 9.0.

7. The method recited in claim 6 wherein the temperature of the composition of step (a) is in the range of from about 225° F. to about 275° F.

8. The method recited in claim 7 wherein the temperature of the composition of step (c) is adjusted to about 150° F.

9. The method recited in claim 8 wherein said phosphonic acid is aminotrimethylene phosphonic acid and the amine and alkali metal salts of the acid.

10. The method recited in claim 9 wherein said metal surface is a ferrous metal surface.

11. The method recited in claim 10 wherein the iron content of the scale removing composition exceeds 1.0 percent by weight of said composition during said cleaning.

12. A method of removing iron and copper containing scale from a metal surface comprising the steps of:

(a) contacting said scale containing surface at a temperature of from about 225° F. to about 275° F. with an aqueous scale removing composition having a pH of from about 8.0 to about 10.5 and comprising (i) an aminopolycarboxylic acid selected from the group consisting of ethylenediaminetetraacetic acid, N-hydroxyethylethylenediaminetriacetic acid, nitrilotriacetic acid, N-2-hydroxyethyliminodiacetic acid, diethylenetriaminepentaacetic acid, N-2-hydroxyethylethylenediaminetriacetic acid, propylene-1,3-diaminetetraacetic acid, propylene-1,2-diaminetetraacetic acid, the alkali metal, amine and ammonium salt of the aminopolycarboxylic acids, and mixtures thereof; and (ii) a phosphonic acid selected from the group consisting of aminotri-methylenephosphonic acid, ethylenediaminetetra-methylenephosphonic acid, hexamethylenediaminetetra-methylenephosphonic acid, 1-hydroxyethylidene-1,1-diphosphonic acid the alkali metal, amine and ammonium salt of the phosphonic acid and mixtures thereof;

(b) maintaining said composition in contact with said scales for a time sufficient to remove said iron containing scale from the ferrous metal surface;

(c) adjusting said pH of said composition to from about 8.0 to about 10.5 when said pH of said composition is outside the range of from about 8.0 to about 10.5 and said temperature to from about 120° F. to about 180° F. when said temperature is outside the range of from about 120° F. to about 180° F. prior to removal of said copper containing scale; and, (d) contacting said copper containing scales with said composition for a time sufficient to remove said copper containing scales from said surface;

wherein said aminopolycarboxylic acid and said phosphonic acid are present in said composition in an amount sufficient to produce a molar ratio of aminopolycarboxylic to phosphonic acid of from about 1:9 to about 39:1, wherein the combined weight of the aminocarboxylic acid and phosphonic acid present in said composition is in the range of from about 1.5 percent by weight to about 6.0 percent by weight of the composition, and wherein the composition of step (c) further comprises an oxidizing agent present in an amount sufficient to oxide substantially all the ferrous ions present in said composition to ferric ions and substantially all the copper which is to be removed from said metal surface to cupric ions.

13. The method recited in claim 12 wherein said aminopolycarboxylic acid is selected from the group consisting of NTA, EDTA, the alkali metal salts of these acids, and mixtures thereof.

14. The method recited in claim 13 wherein the molar ratio of the aminopolycarboxylic acid to phosphonic acid is in the range of from about 1:1 to about 19:1.

15. The method recited in claim 14 wherein tne molar ratio of the aminopolycarboxylic acid to the phosphonic acid is about 9:1.

16. The method recited in claim 15 wherein tne iron content of the scale removing composition exceeds 1 percent by weight of composition during said cleaning.

17. The method recited in claim 16 wherein the phosphonic acid or the alkali metal salt or ammonium salt or amine salt of such acid is aminotrimethylene phosphonic acid.

* * * * *